US009739476B2

(12) United States Patent
Shenoy et al.

(10) Patent No.: US 9,739,476 B2
(45) Date of Patent: Aug. 22, 2017

(54) EVAPORATOR APPARATUS AND METHOD OF OPERATING THE SAME

(71) Applicant: ALSTOM Technology Ltd, Baden (CH)

(72) Inventors: Suresh K. Shenoy, Cromwell, CT (US); Jay Brian Anderson, Coventry, CT (US); Rahul J. Terdalkar, East Windsor, CT (US); Donald William Bairley, Farmington, CT (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 449 days.

(21) Appl. No.: 14/085,955

(22) Filed: Nov. 21, 2013

(65) Prior Publication Data

US 2015/0136045 A1 May 21, 2015

(51) Int. Cl.

| | |
|---|---|
| ***F22B 15/00*** | (2006.01) |
| ***F22B 35/14*** | (2006.01) |
| ***F22B 37/22*** | (2006.01) |

(52) U.S. Cl.

CPC ..... *F22B 35/14* (2013.01); *F22B 15/00* (2013.01); *F22B 37/22* (2013.01)

(58) Field of Classification Search

CPC ..... F22B 37/228; F22B 35/14; F22B 35/04; F22B 29/12; F22B 29/02; F22B 1/18; F01K 23/10; B01D 53/36

USPC ..... 122/406.5, 406.1, 1 B, 1 C, 7 R, 279

See application file for complete search history.

(56) References Cited

U.S. PATENT DOCUMENTS

| | | | | |
|---|---|---|---|---|
| 3,756,023 | A | 9/1973 | Berman | |
| 4,693,213 | A * | 9/1987 | Yanai | B01D 53/8631 122/421 |
| 4,932,204 | A | 6/1990 | Pavel et al. | |
| 5,881,551 | A | 3/1999 | Dang | |
| 6,173,679 | B1 | 1/2001 | Bruckner et al. | |
| 6,957,630 | B1 * | 10/2005 | Mastronarde | F22B 1/1815 122/406.4 |

(Continued)

FOREIGN PATENT DOCUMENTS

| | | |
|---|---|---|
| AT | 303077 B | 11/1972 |
| JP | S60216010 A | 10/1985 |

(Continued)

*Primary Examiner* — Steven B McAllister
*Assistant Examiner* — Ko-Wei Lin
(74) *Attorney, Agent, or Firm* — GE Global Patent Operation; Stephen G. Midgley

(57) ABSTRACT

A heat exchanger apparatus for receiving water from a steam drum (1) and providing steam and heated unevaporated liquid water to the steam drum includes a first evaporator (EVAP-1) and a second evaporator (EVAP-2). The first evaporator can receive water from a steam drum via a first feed conduit (9) and the second evaporator can receive water from a second feed conduit (11). Both evaporators can output heated fluid to the steam drum via a combined evaporator output conduit (13). Each first evaporator passageway (14) only makes a single pass through a gas duct (15) having a heated gas flow (7) passing therethrough while each second evaporator passageways (24) can make one or more passes through the gas duct for transferring heat from the gas to the fluid within the evaporators. A portion of the first feed conduit can also have a pre-specified volume a pre-specified height below the first inlet (10).

18 Claims, 3 Drawing Sheets

(56) References Cited

U.S. PATENT DOCUMENTS

| | | | | |
|---|---|---|---|---|
| 7,481,060 | B2 | 1/2009 | Haertel et al. | |
| 2004/0149239 | A1* | 8/2004 | Franke | F02C 6/18 122/406.4 |
| 2007/0119388 | A1 | 5/2007 | Waseda et al. | |
| 2011/0239961 | A1 | 10/2011 | Bauver, II et al. | |
| 2012/0180739 | A1* | 7/2012 | Rop | F22B 1/18 122/7 R |
| 2012/0240871 | A1 | 9/2012 | Bairley et al. | |
| 2013/0180471 | A1 | 7/2013 | Truong et al. | |
| 2013/0186594 | A1 | 7/2013 | Douchy et al. | |
| 2013/0192810 | A1 | 8/2013 | Lech et al. | |

FOREIGN PATENT DOCUMENTS

| | | | | |
|---|---|---|---|---|
| JP | H01273901 | A | | 1/1989 |
| JP | 01155007 | A | * | 6/1989 |
| JP | H01155007 | A | | 6/1989 |
| NL | 9402107 | A | | 7/1996 |
| WO | 2005/068904 | | | 7/2005 |

* cited by examiner

EVAPORATOR APPARATUS AND METHOD OF OPERATING THE SAME

TECHNICAL FIELD

The present disclosure relates to evaporators configured to evaporate water into steam.

BACKGROUND

A heat recovery steam generator ("HRSG") is a device that may include one or more ducts through which hot gas may be used by heat exchangers to transfer heat from the hot gas to a fluid. Examples of heat exchanges may be found in U.S. Patent Application Publication Nos. 2013/0186594, 2013/0180471, 2013/0192810, 2012/0240871, 2011/0239961 and 2007/0119388 and U.S. Pat. Nos. 3,756,023, 4,932,204, 5,881,551, 6,173,679, and 7,481,060.

Known vertical HRSG evaporators include horizontal evaporator tubes that can have instabilities during evaporator start-up operations. The evaporators can feed steam and heated liquid water to a steam drum, which also can experience water level instabilities during start-up operations. Recirculation pumps can address such instabilities by preventing a reverse flow, or back-flow, of steam to the steam drum. Such a feature can also address a water hammer condition, which can require the evaporators to be shut down. Recirculation pumps can impact operational and maintenance costs.

SUMMARY

According to aspects illustrated herein, there is provided an evaporator apparatus for receiving liquid water from a steam drum and providing at least one of steam and heated liquid water to the steam drum. The evaporator apparatus comprises a first evaporator having a first inlet for receiving liquid water, and having at least one first evaporator conduit. Each first evaporator conduit defines at least one first evaporator passageway extending from the first inlet through a gas duct in a single pass to a first outlet for transferring heat from gas to water within the first evaporator passageway. A length of the first evaporator passageway extending through the gas duct is substantially perpendicular to a gas flow axis along which the gas will flow through the gas duct during operation. A second evaporator has a second inlet for receiving liquid water and has at least one second evaporator conduit extending from the second inlet through the gas duct to a second outlet for transferring heat from the gas to water.

According to other aspects illustrated herein, there is provided an evaporator apparatus that includes a first evaporator for receiving liquid water at a first inlet. The first evaporator has at least one first evaporator conduit defining a first evaporator passageway extending from the first inlet through a gas duct to a first outlet of the first evaporator for transferring heat, during operation, from gas passing within the gas duct to water within the first evaporator passageway. A second evaporator for receiving liquid water at a second inlet has at least one second evaporator conduit defining a second evaporator passageway extending from the second inlet through the gas duct to a second outlet. The second evaporator passageway is arranged for transferring heat from the gas to water. An output conduit is in communication with the first outlet of the first evaporator and the second outlet of the second evaporator for outputting at least one of steam and heated liquid water from both the first and second evaporators.

According to other aspects illustrated herein, there is provided a method of operating an evaporator apparatus arranged in combination with a vertical HRSG. The method includes the step of supplying liquid water from a steam drum to a first feed conduit of a first evaporator. The first evaporator has at least one first evaporator conduit that defines a first evaporator passageway extending from a first inlet through a gas duct in a single pass to a first outlet of the first evaporator for transferring heat from gas passing along a gas flow axis within the gas duct to water within the first evaporator passageway. The length of the first evaporator passageway that extends through the gas duct to define the single pass can be substantially perpendicular to the gas flow axis. The method also includes the step of supplying liquid water from the steam drum to a second feed conduit of a second evaporator. The second evaporator has at least one second evaporator conduit extending through the gas duct of the HRSG adjacent the first evaporator conduit. The second evaporator conduit defines a second evaporator passageway extending from a second inlet through the gas duct to a second outlet of the second evaporator for transferring heat from the gas to water. The method additionally includes the steps of feeding liquid water from the steam drum to the first inlet via the first feed conduit and feeding liquid water from the steam drum to the second inlet via the second feed conduit.

The above described and other features are exemplified by the following figures and detailed description.

BRIEF DESCRIPTION OF THE DRAWINGS

Referring now to the figures, which are exemplary embodiments, and wherein like elements are numbered alike.

Other details, objects, and advantages of embodiments of the innovations disclosed herein will become apparent from the following description of exemplary embodiments and associated exemplary methods.

DETAILED DESCRIPTION

Exemplary embodiments of an evaporator apparatus disclosed herein can be configured to address back-flow and steam drum instabilities that can occur during start-up operations of an evaporator or heat exchanger. For example, a natural circulation of water can be provided between a steam drum and evaporator so that recirculation pumps are not needed to address back-flow and steam drum level instabilities. If desired, recirculation pumps can be included as an optional back-up safety measure.

Figure 1:
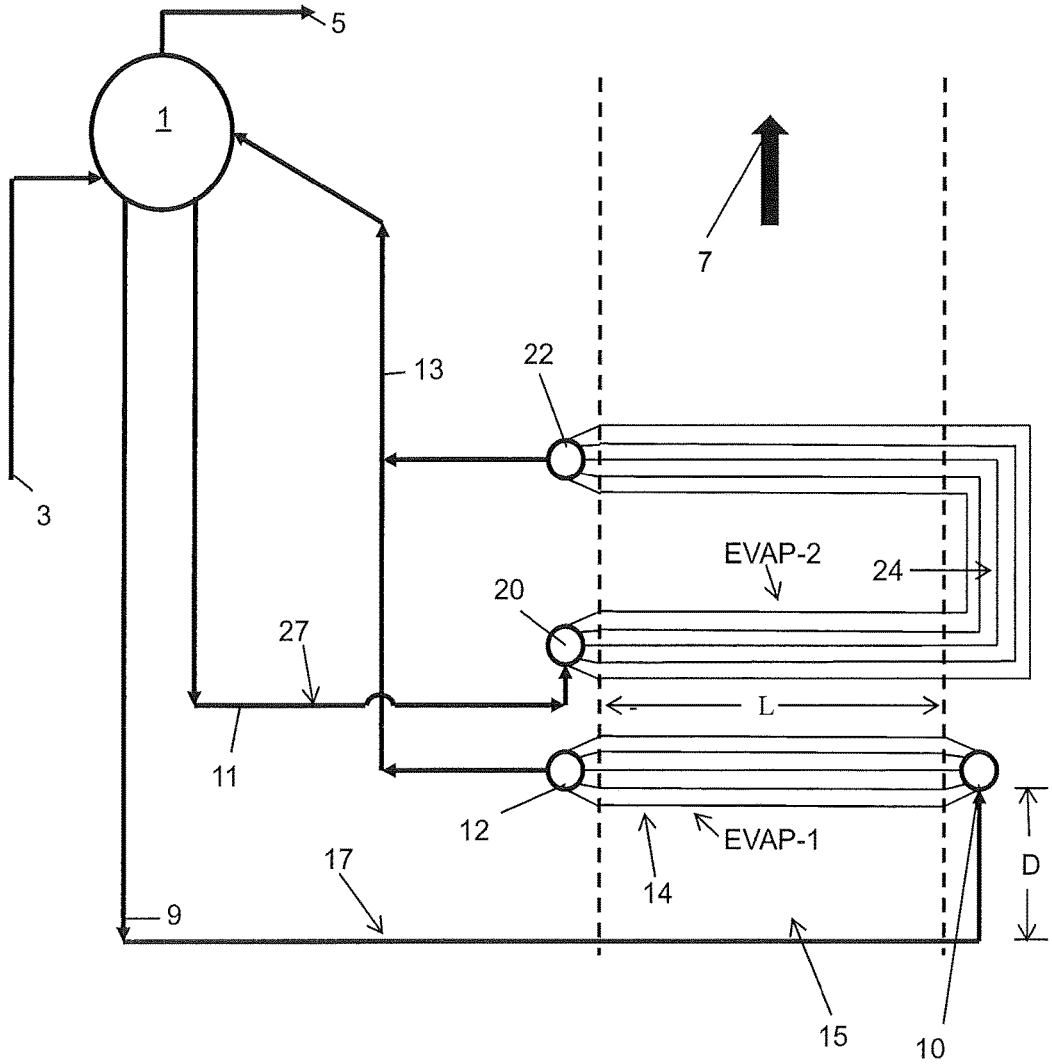
FIG. 1 is a block diagram of a first exemplary embodiment of an evaporator.

FIG. 1 shows an exemplary evaporator apparatus as disclosed herein to receive liquid water from a steam drum 1. The steam drum 1 can receive the water from a water inlet 3, and can output steam via a steam drum outlet 5.

During operation of the steam drum, liquid water can be passed from the steam drum 1 to a set of evaporators. A first feed conduit 9 and a second feed conduit 11 can each feed liquid water from the steam drum 1 to a first evaporator EVAP-1 or a second evaporator EVAP-2. The first feed conduit 9 can be one or more pipes, valves, tubes, vessels, ducts, or other types of conduit elements that define a first passageway through which liquid water flows from the steam drum 1 to a first inlet 10 of the first evaporator EVAP-1. The second feed conduit 11 can also be one or more interconnected pipes, valves, tubes, vessels, ducts, or other types of conduit elements that define a passageway through which liquid water flows from the steam drum 1 to a second inlet 20 of the second evaporator EVAP-2. The first and second feed conduits 9 and 11 can each be considered a downcomer in some embodiments of the evaporator apparatus.

The water received by the evaporators can be supplied through one or more evaporator conduits of the first and second evaporators EVAP-1 and EVAP-2. The water will be heated via heated gas flow 7 through at least one HRSG duct 15 to form steam.

The steam and any unevaporated heated liquid water is output by both the first and second evaporators EVAP-1 and EVAP-2 via a combined evaporator output 13. This output can be a conduit that connects the first and second evaporators to the steam drum 1 so that the steam and heated unevaporated liquid water from both evaporators is mixed together within a common conduit prior to being fed to the steam drum 1. The combined evaporator output conduit 13 can be a combined riser conduit, formed as one or more interconnected pipes, tubes, vessels, ducts, valves, or other types of conduit elements that define a passageway through which steam flows from the first and second evaporator outlets 12, 22 to the steam drum 1.

The combined evaporator output 13 can provide advantages during start-up operations of the evaporator apparatus. For example, during start-up, the combined evaporator output 13 can facilitate naturally occurring steam circulation in a desired direction. Steam will be emitted from the first evaporator EVAP-1 prior to steam being formed in, and output from, the second evaporator EVAP-2. Steam will form more quickly in the first evaporator EVAP-1 because water is heated therein via a hot gas which passes through the HRSG in a single pass through the HRSG duct 15.

The first evaporator EVAP-1 is positioned adjacent (e.g., lower than) the second evaporator EVAP-2 in the vertical HRSG duct 15. Water in the first evaporator EVAP-1 is thereby exposed to hotter gas for heat transfer. By the time the second evaporator EVAP-2 begins to output steam, the pressure and temperature within the combined evaporator output 13 is higher due to the presence of the steam and heated evaporator liquid output from the first evaporator EVAP-1 being within the combined evaporator output 13.

As such, there is a less dramatic pressure increase in the system that can arise from steam being output from the second evaporator EVAP-2. This can reduce potential instabilities in water level occurring during start-up that can result in water hammer conditions. That is, temperature and pressure conditions within the combined evaporator output 13 can mitigate against sudden condensation of steam by avoiding the otherwise cooler start-up conditions in the steam drum 1 to which the combined evaporator output 13 is fed.

The one or more first evaporator conduits each defines a first evaporator passageway 14 extending from the first inlet 10 of the first evaporator EVAP-1 to a first outlet 12 of the first evaporator EVAP-1. Each first evaporator passageway 14 extends through a gas duct, such as an HRSG duct 15, for transferring heat from gas passing in a first direction along a gas flow axis within the gas duct to water within the first evaporator passageway. Each first evaporator passageway makes only a single pass through the gas duct from the first inlet 10 to the first outlet 12 of the first evaporator EVAP-1. Each first evaporator passageway 14 extends along a length L through the gas duct for defining the single pass through the gas duct which is substantially perpendicular (e.g., less than 45 degrees to perpendicular) to the gas flow axis of the gas flow 7 passing through the gas duct.

For example, the gas flow 7 can be in a vertical direction along the gas flow axis such that the heated gas flows from a lower part of the HRSG duct 15 to an upper part of the HRSG duct 15. Each first evaporator passageway of the first evaporator EVAP-1 can extend substantially perpendicular thereto (e.g., horizontally or substantially horizontally along a linear inclination or declination of between 0° and 5°) along the length L of the first evaporator passageway). The gas flow axis can vertically extend such that the gas flows vertically through the gas duct in a direction that is perpendicular or substantially perpendicular (e.g. a direction that is within 5° or within 10° of being perpendicular) to a direction of water flow through the first evaporator passageway 14.

The second evaporator EVAP-2 also receives liquid water from the steam drum 1 from the second feed conduit 11 at a second inlet 20 of the second evaporator EVAP-2. The second feed conduit 11 can be a conduit that is separate from the first feed conduit 9. For example, each of the first and second feed conduits 9 and 11 can include separate pipes, valves or other conduit elements that define separate passageways that extend from the steam drum to an inlet of a respective one of the first and second evaporators EVAP-1 and EVAP-2. As such, no portion of liquid water from the steam drum 1 passing along the first feed conduit 9 to the inlet of the first evaporator EVAP-1 can mix with liquid water passing from the steam drum 1 to the inlet of the second evaporator EVAP-2.

The second evaporator has at least one second evaporator conduit extending through the HRSG duct 15, which can be considered a gas duct. Each second evaporator conduit defines at least one second evaporator passageway 24 extending from the second inlet 20 via a gas duct to a second outlet 22 of the second evaporator for transferring heat from gas to water within the second evaporator passageway. For example, each second evaporator passageway 24 can define only one pass through the gas duct or can be configured to define two, three, or more than three passes through the gas duct for transferring heat from heated gas passing within the duct to water within the second evaporator conduit of the second evaporator passageway.

When defining multiple passes through the HRSG duct 15, the second evaporator passageway can be configured so that the second inlet 20 and second outlet 22 of the second evaporator EVAP-2 are positioned on or adjacent to the same side of the HRSG duct as shown in FIG. 1 or may alternatively be configured so that the second inlet 20 and second outlet 22 are on or adjacent to opposite sides of the HRSG duct. For example, each second evaporator passageway 24 can include curved or angled segments to help define a second passageway having a reverse "C" arrangement as shown in FIG. 1 or alternatively may be configured so that the second evaporator passageway has a "C" arrangement, or other arrangement.

Each second evaporator passageway can be positioned adjacent (e.g., above) the at least one first evaporator passageway and have one or more passes that each has a length L that extends through the HRSG duct 15. The length L of each pass can be perpendicular or substantially perpendicular (e.g. within 1-10 degrees of being perpendicular to the direction the gas flows or being within 1-5 degrees of being perpendicular to the direction the gas flows) to the gas flow axis of the gas flow 7 passing through the HRSG duct 15.

The gas flow 7 can flow in a vertical direction along the gas flow axis such that the gas flows vertically from a lower part of the HRSG duct to an upper part of the HRSG duct. As such, the second evaporator EVAP-2 and the second evaporator passageways 24 of the second evaporator EVAP-2 can be considered to be downstream of the first evaporator EVAP-1 and first evaporator passageways 14 of the first evaporator EVAP-1.

Each second evaporator passageway of the second evaporator EVAP-2 can include one or more passageway segments that have a length L that extends horizontally or substantially horizontally along the length L through the HRSG duct 15. The gas flow axis can be a vertically extending axis such that the gas passes vertically through the gas duct and travels in a direction that is perpendicular or substantially perpendicular to a direction at which water flows through the horizontal second evaporator passageway of the HRSG gas duct 15.

In exemplary embodiments, each second evaporator passageway of the second evaporator EVAP-2 can define at least two horizontally extending passes through the gas duct between the second inlet and the second outlet that are positioned entirely above the first evaporator. For instance, each second evaporator passageway can be configured to define two horizontally extending passes through the gas duct that are both above the first evaporator passageway of the first evaporator EVAP-1.

The first feed conduit 9 can have a portion (e.g., a lowermost portion 17) that is at a height located at a pre-specified distance D from (e.g., vertically below) the inlet of the first evaporator EVAP-1. In exemplary embodiments, the pre-specified distance D can be one of: between 0.1 and 10 meters from (e.g., below) the first inlet of the first evaporator EVAP-1, between 1 and 6 meters from the first inlet 10 of the first evaporator EVAP-1, between 1 and 2 meters from the first inlet of the first evaporator EVAP-1, and at least 1 meter from the first inlet 10 of the first evaporator EVAP-1. Such a configuration for the first feed conduit 9 can facilitate natural circulation during start-up operations, and inhibit (e.g., prevent) the reverse flow of steam from the first evaporator EVAP-1 into the first feed conduit 9.

For example, a lowermost portion 17 of the first feed conduit can include a pre-specified percentage of a total volume of the one or more first evaporator passageways through which water passes to prevent steam formed in the first evaporator passageway(s) from flowing into the first feed conduit 9 during start-up operations of the evaporator apparatus. For instance, the length, depth, and width of a lowermost portion of the first feed conduit can be configured to ensure that the pre-specified volume of the first feed conduit is positioned a desired height below the inlet of the first evaporator EVAP-1.

The pre-specified volume of a lowermost portion of the first feed conduit 9 that is a pre-specified distance D from the inlet of the first evaporator EVAP-1 can, for example, be between 0.2% and 20% of the total volume of the one or more first evaporator passageways through which water passes, at least 0.5% of the volume of the one or more first evaporator passageways, or between 1% and 10% of the total volume of the one or more first evaporator passageways through which water passes. An exemplary lowermost portion of the first feed conduit 9 can include a section of the first feed conduit that extends horizontally at a particular height or can include a portion of the first feed conduit that extends diagonally from a lowermost point to another more elevated position that is below the desired height specifications (e.g. between 0.1 and 10 meters, between 1 and 6 meters, or between 1 and 2 meters below the inlet of the first evaporator EVAP-1). An entirety of the conduit portion, or conduit portions, of the first feed conduit that is at a height that is at or below a minimum pre-specified distance D from the inlet of the first evaporator EVAP-1 can be considered to be the lowermost portion of the first feed conduit 9.

Additionally, the second feed conduit 11 can have a portion (e.g., a lowermost portion 27) that is located at an elevation that is a pre-specified distance D from (e.g., below) an elevation of the inlet of the second evaporator EVAP-2. The pre-specified distance D can, for example, be one of: between 0.1 and 10 meters below the inlet of the second evaporator EVAP-2, between 1 and 6 meters below the inlet of the second evaporator EVAP-2, between 1 and 2 meters below the inlet 20 of the second evaporator EVAP-2, and at least 1 meter below the second inlet 20 of the second evaporator EVAP-2. Such a configuration for the second feed conduit 11 can facilitate natural circulation during start-up operations and inhibit (e.g., prevent) reverse flow of steam from the second evaporator EVAP-2 into the second feed conduit 11 and to the steam drum 1, and also help inhibit (e.g., prevent) water level instabilities during start-up operations.

For example, a lowermost portion 27 of the second feed conduit 11 can include a pre-specified percentage of a total volume of the one or more second evaporator passageways through which water passes to prevent steam formed in any of the second evaporator passageways from reverse flow into the second feed conduit 11 during start-up operations of the evaporator apparatus, and to prevent water level instabilities. The length, depth, and width of the lowermost portion of the second feed conduit 11 can be selected to ensure that a pre-specified volume of the second feed conduit 11 through which water flows can be positioned within a desired height range below the inlet of the second evaporator EVAP-2. The pre-specified volume of the lowermost portion of the second feed conduit 11 through which water passes can be, for example, between 0.2% and 20% of the total volume of the one or more second evaporator passageways through which water passes, at least 0.5% of the volume of the one or more second evaporator passageways, or between 1% and 15% of the total volume of the one or more second evaporator passageways through which water passes.

The exemplary lowermost portion of the second feed conduit 11 can include a section of the second feed conduit 11 that extends horizontally at a particular height, or can include a portion of the second feed conduit that extends diagonally from a lowermost point to another more elevated position that is below the desired height specification (e.g., between 0.1 and 10 m, between 1 and 6 meters, or between 1 and 2 meters below the inlet of the second evaporator EVAP-2). An entirety of the conduit portion, or conduit portions, of the second feed conduit 11 that is at a height that is at or below the minimum pre-specified distance D from the inlet of the second evaporator EVAP-2 can be considered to be the lowermost portion of the second feed conduit 11.

A fluid can be supplied into at least one of the steam drum 1 and combined evaporator output 13. This can increase the operating pressure of the steam drum 1, first evaporator EVAP-1, and second evaporator EVAP-2 to avoid instabilities that can result in a water hammer condition.

For example, a water hammer condition may occur during a cold start-up of an evaporator apparatus due to a large portion of steam from the evaporators condensing upon contact with cooler conditions present in the evaporator apparatus, and can create instability in the water level of the steam drum and liquid water in the combined evaporator output 13. In addition, the increasing of the pressure of the steam drum 1 and first and second evaporators during start-up can inhibit (e.g., prevent) steam formed in the one or more passageways of the first evaporator EVAP-1 and/or second evaporator EVAP-2 that passes through the HRSG duct 15 from flowing into the first feed conduit 9 and/or second feed conduit 11 during start-up operations of the evaporator apparatus. The fluid can subsequently be blocked from passing into the steam drum 1 or combined evaporator output 13 when the evaporator apparatus reaches a steady-state operating condition for forming steam from liquid water received via the first and second feed conduit 9 and 11.

The fluid that is passed into the steam drum 1 and/or combined evaporator output 13 can be nitrogen, air, steam, or other gas or fluid that can be configured to safely pressurize the steam drum, combined evaporator output 13, and evaporators to avoid start-up instabilities that can relate to water hammer formation, and also help prevent steam from flowing into the first and/or second feed conduits 9 and 11. A pump or fan can be in communication with a source of fluid and pressurized fluid feed line and can be selectively actuated to feed fluid to the steam drum 1 and/or combined evaporator output 13 for pressurizing the steam drum 1, combined evaporator output 13 and evaporators during start-up. The fluid can be passed into the steam drum 1 and/or combined evaporator output 13 to increase the operating pressure and maintain the operating pressure of the first and second evaporators to a pressure level of, for example: (i) at least two atmospheres, (ii) between two atmospheres and six atmospheres, or (iii) to a pressure that is between two atmospheres and eighty atmospheres during start-up operations until the evaporator apparatus reaches a steady-state operating condition.

Figure 2:
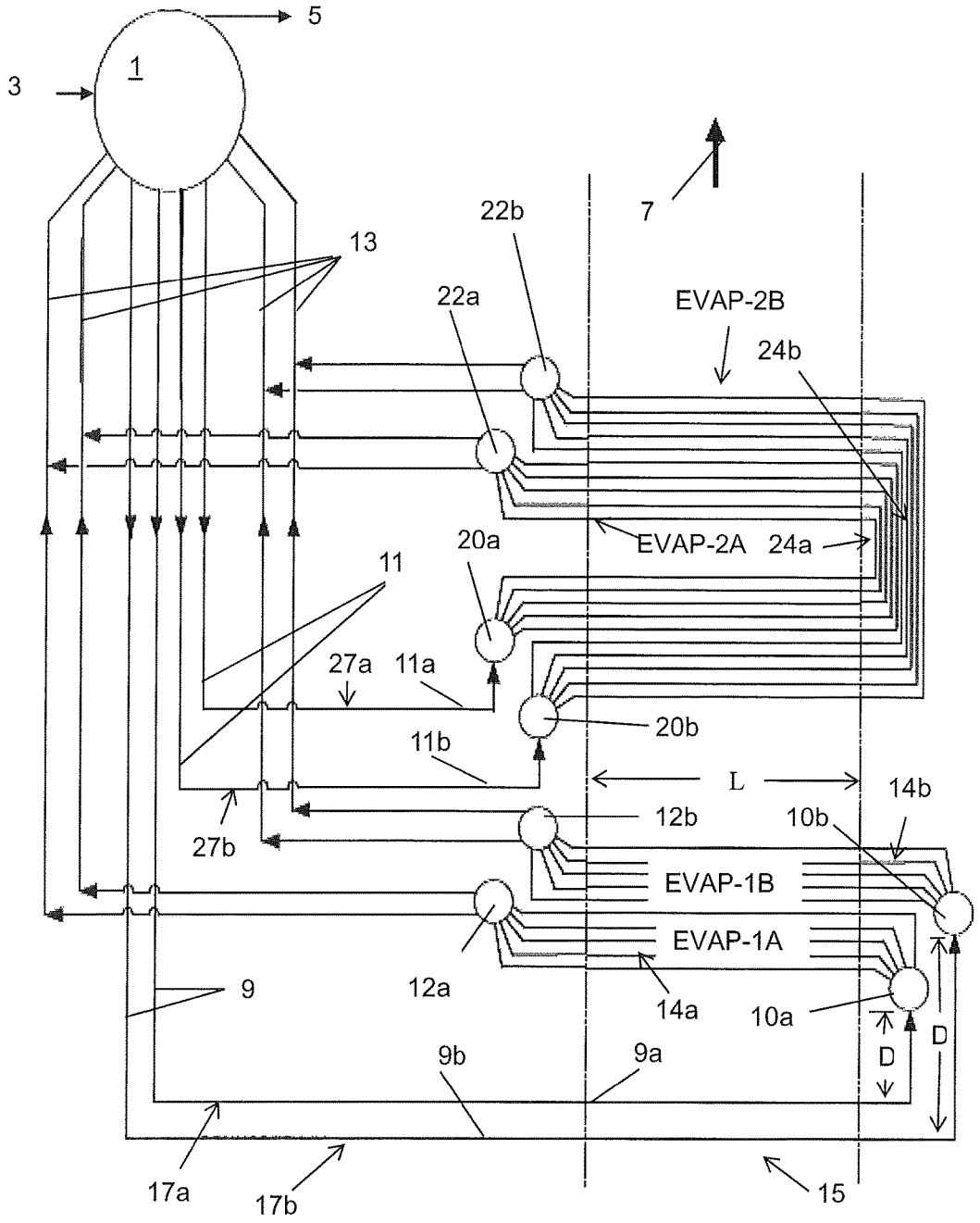
FIG. 2 is a block diagram of a second exemplary embodiment of an evaporator.

FIG. 2 illustrates that exemplary embodiments of an evaporator apparatus as disclosed herein can include multiple sets of first and second evaporators EVAP-1 and EVAP-2. For example, two first evaporators EVAP-1A and EVAP-1B can be positioned in a lower portion of a vertical HRSG duct 15, and two second evaporators EVAP-2A and EVAP-2B can be positioned above those first evaporators EVAP-1A and EVAP-1B.

Each first evaporator EVAP-1A, EVAP-1B can have its own first feed conduit 9*a*, 9*b* extending from the steam drum 1 to an inlet 10*a*, 10*b* so that liquid water is flowable from the steam drum 1 to the first evaporators. Each first feed conduit 9*a*, 9*b* may have a lowermost portion 17*a*, 17*b* that is at least a pre-specified distance D below the first inlet 10*a*, 10*b* to which it feeds liquid water. Each first evaporator can include first evaporator passageways 14*a*, 14*b* through which water passes to an outlet 12*a*, 12*b* that is connected to a combined evaporator output 13 for supplying steam and heated unevaporated liquid to the steam drum 1. Each second evaporator EVAP-2A, EVAP-2B can also receive liquid water from the steam drum 1 from a respective separate second feed conduit 11*a*, 11*b* at a second inlet 20*a*, 20*b*. Each second feed conduit 11*a*, 11*b* can have a lowermost portion 27*a*, 27*b* that is a pre-specified distance below the second inlet 20*a*, 20*b* of the second evaporator EVAP-2A, EVAP-2B. Each second evaporator EVAP-2A, EVAP-2B can be configured to heat the received water via heat transfer from the gas flowing in HRSG duct 15 via second evaporator passageways 24*a*, 24*b*, and can output steam and unevaporated heated liquid water to the steam drum 1 via a combined evaporator output 13.

Each combined evaporator output 13 can include a conduit connecting a second outlet 22*a*, 22*b* of a second evaporator EVAP-2A, EVAP-2B to a first outlet 10*a*, 10*b* of one of the first evaporators EVAP-1A, EVAP-1B. For instance, each first outlet 12*a*, 12*b* of each first evaporator EVAP-1A, EVAP-1B can be communicatively connected to a combined outlet conduit 13 that also receives steam from a second outlet 22*a*, 22*b* of a respective one of the second evaporators EVAP-2.

In exemplary embodiments, each of the first and second evaporators EVAP-1 and EVAP-2 can have multiple different output lines that each output steam from the evaporator to a combined riser conduit or other combined evaporator output 13. For example, there is a total of four feed conduits 9*s*, 9*b*, 11*a*, 11*b* and two or more combined output conduits 13 in the embodiment of the evaporator apparatus as shown in FIG. 2 so that liquid water can pass from the steam drum 1 to the evaporators, and so that steam and heated unevaporated liquid water can be passed from the evaporators to the steam drum 1. As such, steam flows supplied from a first evaporator and a second evaporator are combined prior to being fed to the steam drum 1.

In exemplary embodiments, there can be at least two sets of first and second evaporators EVAP-1 and EVAP-2 where one set of first and second evaporators is located above or below another set of first and second evaporators positioned in at least one HRSG duct 15.

Figure 3:
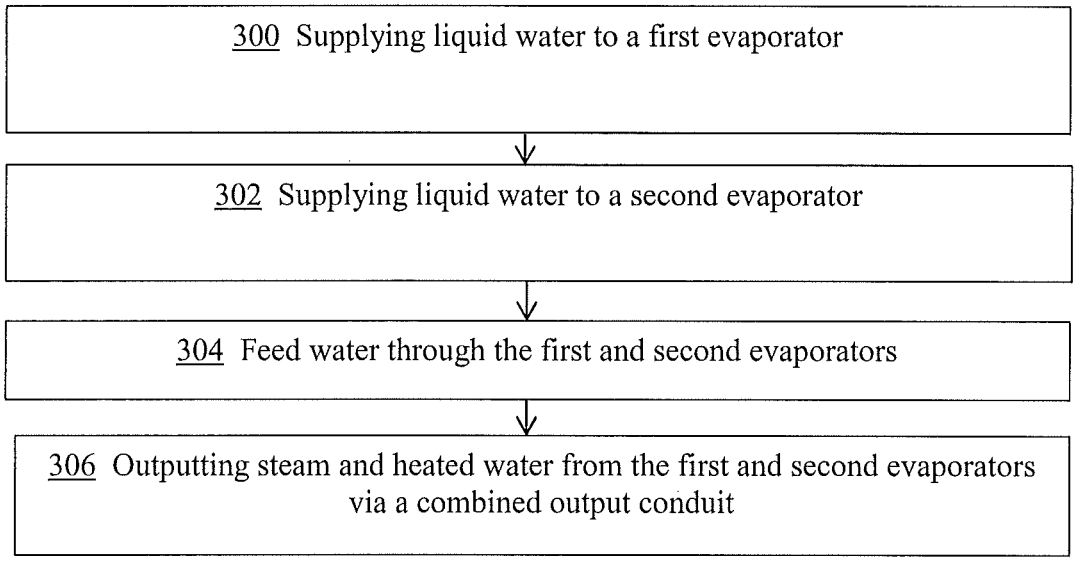
FIG. 3 is a flow chart of an exemplary method of operating an evaporator apparatus.

Operation of the exemplary embodiments illustrated herein will now be described. FIG. 3 shows that an exemplary method can include the step 300 of supplying liquid water from a steam drum to a first feed conduit of a first evaporator having at least one first evaporator conduit. The first evaporator conduit defines a single first evaporator passageway extending from a first inlet through a gas duct to a first outlet of the first evaporator for transferring heat from gas passing along a gas flow axis within the gas duct to water within the first evaporator passageway. The first evaporator passageway is substantially perpendicular to the gas flow axis.

The method includes the step 302 of supplying liquid water from the steam drum to a second feed conduit of a second evaporator having at least one second evaporator conduit extending through the gas duct of the HRSG adjacent the first evaporator conduit. The second evaporator conduit defines a second evaporator passageway extending from a second inlet through the gas duct to a second outlet of the second evaporator for transferring heat from the gas to water.

The method can include the step 304 of passing water through the first and second evaporators to heat the water and the step 306 of outputting steam and heated unevaporated water from the first and second evaporators to the steam drum via at least one combined evaporator output conduit.

It will be appreciated that embodiments of the evaporator apparatus and methods of using and operating the same can differ to meet different sets of design criteria. For example, the second evaporator EVAP-2 can include conduits that only define one pass through a gas duct for transferring heat from the gas passing within the gas duct to the water within the conduits of the second evaporator EVAP-2 or can make any number of desired passes through the gas duct (e.g. 2, 3, 4, etc. passes through the gas duct).

As another example, the feed conduit for the second evaporator EVAP-2 may not be configured to have a lowermost portion that is positioned at least a certain pre-specified distance D below the inlet of the second evaporator EVAP-2. In exemplary embodiments, only the first feed conduit 9 can be configured with different positioning of a lowermost conduit portion.

In alternate embodiments, the size, operational parameters and capacities of the steam drum 1, sizes of the first and second feed conduits 9 and 11 and sizes and capacity of the first and second evaporators EVAP-1 and EVAP-2 can be selected to meet any specified design criteria. In addition, a heated gas duct for gas to water heat transfer is not limited to one or more ducts of an HRSG, but rather can be any suitable duct or conduit through which a heated fluid can flow.

While the invention has been described with reference to various exemplary embodiments, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An evaporator apparatus for receiving liquid water from a steam drum and providing at least one of steam and heated liquid water to the steam drum, the evaporator apparatus comprising:

a first evaporator having a first inlet for receiving liquid water, and having at least one first evaporator conduit, each first evaporator conduit defining at least one first evaporator passageway extending from the first inlet through a gas duct to a first outlet for transferring heat from gas to water within the first evaporator passageway, a length of the first evaporator passageway extending through the gas duct being substantially perpendicular to a gas flow axis along which the gas will flow through the gas duct during operation;

a first feed conduit extending from the steam drum and connecting to the first inlet for transporting the liquid water from the steam drum to the first inlet;

a second evaporator having a second inlet for receiving liquid water, and having at least one second evaporator conduit, each second evaporator conduit defining at least one second evaporator passageway extending from the second inlet through the gas duct to a second outlet for transferring heat from the gas to water;

a second feed conduit extending from the steam drum and connecting to the second inlet for transporting the liquid water from the steam drum to the second inlet;

an output conduit in communication with the first outlet of the first evaporator and the second outlet of the second evaporator, and with the steam drum, the output conduit being configured for outputting at least one of steam and heated liquid water from both the first and second evaporators to the steam drum;

wherein the first feed conduit and the second feed conduit are separate flow lines that extend from the steam drum to the first inlet and the second inlet, respectively, such that no portion of the liquid water from the steam drum passing along the first feed conduit can mix with the liquid water from the steam drum passing along the second feed conduit;

wherein a number of passes of each second evaporator passageway through the gas duct is greater than a number of passes of each first evaporator passageway through the gas duct;

wherein the second evaporator is positioned in the gas duct above the first evaporator; and wherein the greater number of passes of each second evaporator passageway through the gas duct relative to the number of passes of each first evaporator passageway through the gas duct, and the location of the second evaporator above the first evaporator, ensures that the steam forms more quickly in the first evaporator than the second evaporator and exits the first evaporator and enters the output conduit prior to exiting the second evaporator and entering the output conduit during a startup operation to reduce instability during the startup operation.

2. The evaporator apparatus of claim 1, wherein each first evaporator passageway extends through the gas duct, such that during operation gas will pass vertically through the gas duct in a direction that is substantially perpendicular to a direction of water flow through the first evaporator passageway.

3. The evaporator apparatus of claim 1, wherein the first feed conduit includes a first portion located at a position that is between 0.1 and 10 meters below the first inlet.

4. The evaporator apparatus of claim 1, wherein a first portion of the first feed conduit is located a pre-specified distance below the first inlet and defines a volume for liquid water to pass therethrough that is at least equal to a pre-specified percentage of a total volume of the first evaporator passageway to prevent steam formed in the first evaporator passageway from flowing into the first feed conduit during start-up operation of the evaporator apparatus.

5. The evaporator apparatus of claim 1, comprising:

the steam drum;

wherein the evaporator apparatus is configured to:

pass a fluid into the steam drum for increasing operating pressure of the steam drum, and for inhibiting start-up instabilities during start-up operation of the evaporator apparatus, and block the fluid when the first evaporator reaches a steady-state operating condition for forming steam from water received via the first feed conduit.

6. The evaporator apparatus of claim 5, wherein the evaporator apparatus is configured to:

supply fluid for the steam drum for increasing operating pressure of steam drum and the first evaporator and for maintaining the operating pressure of the first evaporator to at least two atmospheres during start-up operations of the evaporator apparatus until the first evaporator reaches a steady state operating condition.

7. An evaporator apparatus for receiving liquid water from a steam drum and providing at least one of steam and heated liquid water to the steam drum, the evaporator apparatus comprising:

a first evaporator for receiving liquid water at a first inlet, the first evaporator having at least one first evaporator conduit, the at least one first evaporator conduit defining a first evaporator passageway extending from the first inlet through a gas duct to a first outlet of the first evaporator for transferring heat, during operation, from gas passing within the gas duct to water within the first evaporator passageway;

a second evaporator for receiving liquid water at a second inlet, the second evaporator having at least one second evaporator conduit defining a second evaporator passageway extending from the second inlet through the gas duct to a second outlet, the second evaporator passageway being arranged for transferring heat from the gas to water;

a first feed conduit for transporting the liquid water from the steam drum to the first inlet;

a second feed conduit for transporting the liquid water from the steam drum to the second inlet; and an output conduit in communication with the first outlet of the first evaporator and the second outlet of the second evaporator for outputting at least one of steam and heated liquid water from both the first and second evaporators and passing the at least one of steam and heated liquid water from both the first and second evaporators to the steam drum;

wherein the first evaporator passageway only makes a single pass through the gas duct and wherein the gas will flow through the gas duct along a gas flow axis in a direction that is substantially perpendicular to a direction water flows through a length of the first evaporator passageway that extends through the gas duct to define the single pass;

wherein the second evaporator passageway makes multiple parallel passes through the gas duct between the second inlet and the second outlet and which are positioned in the gas duct above the first evaporator passageway; and wherein the multiple parallel passes of the second evaporator passageway through the gas duct relative to the single pass of the first evaporator passageway through the gas duct, and the location of the passes of the second evaporator passageway above the first evaporator passageway, ensures that the steam forms more quickly in the first evaporator than the second evaporator and exits the first evaporator and enters the output conduit prior to exiting the second evaporator and entering the output conduit during a startup operation to reduce instability during the startup operation.

8. The evaporator apparatus of claim 7, wherein the first feed conduit has a first portion located at a position that is between 0.1 and 10 meters below the first inlet.

9. The evaporator apparatus of claim 7, wherein:

the gas duct extends vertically;

wherein the first evaporator passageway and the second evaporator passageways extend substantially horizontally across the gas duct; and wherein the first feed conduit has a first portion of the first feed conduit having a pre-specified percentage of a total volume of the first evaporator passageway at a height that is at least a pre-specified distance below a height of the first inlet to prevent steam formed in the first evaporator passageway from flowing into the first feed conduit during start-up operations of the evaporator apparatus.

10. The evaporator apparatus of claim 9, wherein each first evaporator passageway only makes a single pass through the gas duct from the first inlet to the first outlet through the gas duct for defining a solitary pass through the gas duct.

11. The evaporator apparatus of claim 7, comprising:

a first feed conduit connected to the first inlet; and wherein the evaporator apparatus is configured to:

supply a fluid for at least one of a steam drum and the output conduit for increasing operating pressure of the steam drum for inhibiting start-up instabilities in the evaporator apparatus related to formation of a water hammer condition, and inhibit the fluid from passing into the steam drum and the output conduit when the first evaporator reaches a steady-state operating condition for forming steam from water received via the first feed conduit.

12. The evaporator apparatus of claim 11, configured to:

supply fluid for a steam drum for increasing operating pressure of the first evaporator and for maintaining operating pressure of the first evaporator to at least two atmospheres, until the first evaporator reaches the steady-state operating condition.

13. A method of operating an evaporator apparatus arranged in combination with a vertical heat recovery steam generator ("HRSG") having a vertically extending duct configured to provide for a substantially vertical flow of gas, the method comprising:

supplying liquid water from a steam drum to a first feed conduit of a first evaporator having at least one first evaporator conduit, the first evaporator conduit defining a first evaporator passageway extending from a first inlet through the gas duct in a single pass to a first outlet of the first evaporator for transferring heat from gas passing along a gas flow axis within the gas duct to water within the first evaporator passageway, a length of the first evaporator passageway that extends through the gas duct to define the single pass being substantially perpendicular to the gas flow axis;

supplying liquid water from the steam drum to a second feed conduit of a second evaporator having at least one second evaporator conduit extending through the gas duct of the HRSG adjacent the first evaporator conduit, the second evaporator conduit defining a second evaporator passageway extending from a second inlet through the gas duct to a second outlet of the second evaporator for transferring heat from the gas to water;

feeding liquid water from the steam drum to the first inlet via the first feed conduit; and feeding liquid water from the steam drum to the second inlet via the second feed conduit; and supplying steam to a first output conduit from the first outlet of the first evaporator prior to supplying steam to the first output conduit from the second outlet of the second evaporator during startup operations, for feeding the steam from both the first and second evaporators to the steam drum;

wherein the first feed conduit and the second feed conduit are separate flow lines that extend from the steam drum to the first inlet and the second inlet, respectively;

wherein the second evaporator passageway defines at least two substantially parallel passes through the gas duct between the second inlet and the second outlet and which are positioned in the gas duct above the first evaporator passageway;

wherein the at least two substantially parallel passes of the second evaporator passageway through the gas duct relative to the single pass of the first evaporator passageway through the gas duct, and the location of the passes of the second evaporator passageway vertically above the first evaporator passageway within the gas duct, allow the steam to be supplied from the first outlet of the first evaporator to the first output conduit before the steam is supplied from the second outlet of the second evaporator to the first output conduit, thereby reducing instability during the startup operations.

14. The method of claim 13, comprising:

supplying a fluid into the steam drum for increasing operating pressure of the steam drum and the first evaporator until the evaporator apparatus reaches a steady state operating condition, for inhibiting start-up instabilities in the evaporator apparatus related to formation of a water hammer condition.

15. The method of claim 13, comprising:

positioning the first feed conduit such that the first feed conduit has a first portion that is located at a position that is between 0.1 and 10 meters below the first inlet, wherein the first portion of the first feed conduit has a volume at least equal to a pre-specified percentage of a total volume of the first evaporator passageway for inhibiting steam formed in the first evaporator passageway from flowing into the first feed conduit during start-up operations of the evaporator apparatus.

16. The method of claim 13, comprising:

supplying fluid into at least one of the steam drum and the first output conduit for increasing operating pressure of the evaporator apparatus and for maintaining the operating pressure of the first evaporator to at least two atmospheres during start-up operations of the evaporator apparatus until the evaporator apparatus reaches a steady state operating condition.

17. The evaporator apparatus of claim 1, wherein:

the first evaporator includes a plurality of evaporator sets each having an inlet for receiving the liquid water from the steam drum, at least one evaporator conduit defining an evaporator passageway extending from the respective inlet through the gas duct, and an outlet;

the second evaporator includes a plurality of evaporator sets each having an inlet for receiving the liquid water from the steam drum, at least one evaporator conduit defining an evaporator passageway extending from the respective inlet through the gas duct, and an outlet.

18. The evaporator apparatus of claim 1, wherein:

each first evaporator passageway and each second evaporator passageway extends horizontally through the gas duct, such that during operation gas will pass vertically through the gas duct in a direction that is substantially perpendicular to a direction of water flow through the first evaporator passageway and the second evaporator passageways; and wherein the first feed conduit has a lowermost portion that extends horizontally and is located at a height that is at least a pre-specified distance below a height of the first inlet to prevent steam formed in the first evaporator passageway from flowing into the first feed conduit during start-up operations of the evaporator apparatus.

* * * * *